US007868868B2

(12) United States Patent
Kim et al.

(10) Patent No.: US 7,868,868 B2
(45) Date of Patent: Jan. 11, 2011

(54) SHIFT REGISTER AND LIQUID CRYSTAL DISPLAY USING THE SAME

(75) Inventors: Binn Kim, Seoul (KR); Hyung Nyuck Cho, Incheon (KR)

(73) Assignee: LG Display Co., Ltd., Seoul (KR)

( * ) Notice: Subject to any disclaimer, the term of this patent is extended or adjusted under 35 U.S.C. 154(b) by 912 days.

(21) Appl. No.: 11/433,434

(22) Filed: May 15, 2006

(65) Prior Publication Data

US 2006/0279512 A1 Dec. 14, 2006

(30) Foreign Application Priority Data

Jun. 14, 2005 (KR) ..... 10-2005-0050945

(51) Int. Cl.
*G09G 3/26* (2006.01)

(52) U.S. Cl. ..... 345/100; 345/98

(58) Field of Classification Search ..... 345/94, 345/97, 100; 377/64

See application file for complete search history.

(56) References Cited

U.S. PATENT DOCUMENTS

| | | | | |
|---|---|---|---|---|
| 5,745,089 | A * | 4/1998 | Taguchi et al. | 345/89 |
| 2003/0117383 | A1* | 6/2003 | Katoh et al. | 345/204 |
| 2003/0128180 | A1* | 7/2003 | Kim et al. | 345/100 |
| 2005/0156859 | A1* | 7/2005 | Jang et al. | 345/100 |

* cited by examiner

*Primary Examiner*—Amare Mengistu
*Assistant Examiner*—Insa Sadio
(74) *Attorney, Agent, or Firm*—Morgan, Lewis & Bockius LLP

(57) ABSTRACT

A shift register for a gate driving circuit in a liquid crystal display device, the shift register including a plurality of stages, each stage including a control block connected to receive a first clock signal, a start pulse, and a high-level supply voltage to generate a first control signal and a second control signal, and an output block connected to receive a second clock signal, the first control signal, and the second control signal to generate an output voltage in response to the first and second control signals.

12 Claims, 11 Drawing Sheets

SHIFT REGISTER AND LIQUID CRYSTAL DISPLAY USING THE SAME

This application claims the benefit of the Korean Patent Application No. P2005-0050945 filed on Jun. 14, 2005, which is hereby incorporated by reference.

BACKGROUND OF THE INVENTION

1. Field of the Invention

This invention relates to a shift register and a liquid crystal display using the same, and more particularly to a shift register and a liquid crystal display using the same that is adaptive for improving picture quality characteristics.

2. Discussion of the Related Art

Generally, a liquid crystal display (LCD) device controls transmittance of light through a liquid crystal layer using an electric field to thereby display a picture. FIG. 1 shows an active matrix LCD device of a related art.

FIG. 1 shows an active matrix LCD device that includes an LCD panel 13 having (m×n) liquid crystal cells Clc arranged in a matrix array, m data lines D1 to Dm and n gate lines G1 to Gn intersecting each other, and thin film transistors (TFT's) provided at intersections thereof. The active matrix LCD device also includes a data driving circuit 11 for applying video data signals to the data lines D1 to Dm of the LCD panel 13 and a gate driving circuit 12 for applying a scanning pulse to the gate lines G1 to Gn.

The LCD panel 13 has liquid crystal molecules injected between two glass substrates. The data lines D1 to Dm and the gate lines G1 to Gn are provided at the lower glass substrate of the LCD panel 13 and perpendicularly cross each other. The TFT provided at each intersection between the data lines D1 to Dm and the gate lines G1 to Gn applies a data voltage supplied via the data lines D1 to Dn to the liquid crystal cell Clc in response to a scanning pulse from the gate line G1 to Gn. In particular, the gate electrode of the TFT is connected to one of the gate lines G1 to Gn while the drain electrode thereof is connected to one of the data lines D1 to Dm. Further, the source electrode of the TFT is connected to a pixel electrode of the liquid crystal cell Clc. The upper glass substrate of the LCD panel 13 is provided with black matrices, color filters, and common electrodes (not shown). A polarizer (not shown) having a perpendicular light axis is attached onto the upper and lower glass substrates of the LCD panel 13, and an alignment film (not shown) for establishing a free-tilt angle of the liquid crystal is provided at the inner side thereof tangent to the liquid crystal. Each liquid crystal cell Clc of the LCD panel 13 is provided with a storage capacitor Cst. The storage capacitor Cst is provided between the pixel electrode of the liquid crystal cell Clc and the pre-stage gate line or between the pixel electrode of the liquid crystal cell Clc and a common electrode line (not shown), thereby constantly maintaining a voltage of the liquid crystal cell Clc.

The data driving circuit 11 includes a plurality of data driving integrated circuits (ICs), each data driving IC including a shift register, a latch, a digital-to-analog (D/A) converter, and an output buffer. The data driving circuit 11 latches a digital video data and converts the digital video data into an analog gamma compensation voltage to thereby apply them to the data lines D1 to Dm.

The gate driving circuit 12 includes a plurality of gate driving ICs, each of which includes a shift register for sequentially shifting a start pulse every one horizontal period to generate a scanning pulse, a level shifter for converting an output signal of the shift register into a swing width suitable for driving the liquid crystal cell Clc, and an output buffer connected between the level shifter and one of the gate lines G1 to Gn. The gate driving circuit 12 sequentially applies the scanning pulse to the gate lines G1 to Gn to select a horizontal line of the LCD panel 13 supplied with data.

FIG. 2 shows a block diagram of the shift register shown in FIG. 1. In FIG. 2, the shift register is comprised of n stages S_1 to S_n connected in a cascading fashion. A level shifter and an output buffer (not shown) are provided between each of the stages S_1 to S_n and their corresponding gate lines G1 to Gn. A start pulse Vst is input to the first stage S_1 while each of the stages S_2 to S_n receives the output signal of its previous stage (i.e., one of Vg_1 to Vg_n−1) as the start pulse. Further, each of the stages S_1 to S_n has the same circuit configuration and shifts the start pulse Vst or one of the output signals Vg_1 to Vg_n−1 of the previous stages in response to two of four clock signals C1 to C4, thereby generating a scanning pulse having a pulse width of one horizontal period.

FIG. 3 shows an equivalent circuit of a unit pixel including the liquid crystal cell Clc in the LCD panel 13 of the related art. In FIG. 3, "Cgs" represents a parasitic capacitance between the gate and the source of the TFT, "Cgd" represents a parasitic capacitance between the gate and the drain thereof, and "Cds" represents a parasitic capacitance between the drain and the source thereof. Further, "Clc" represents a liquid crystal cell and "Cst" represents a storage capacitor for keeping a voltage of the liquid crystal cell Clc.

FIG. 4 shows a driving signal of the LCD panel 13 based on a SVGA type display. In FIG. 4, "Vd" represents a data voltage output by the data driving circuit 11 to be applied to the data lines D1 to Dm, "Vd+" represents a positive data voltage, and "Vd−" represents a negative data voltage. Further, "Vlc" represents a data voltage charged and discharged at the liquid crystal cell, "Vg" represents a scanning pulse generated at one horizontal period, and "Vcom" represents a common voltage applied to the common electrode of the liquid crystal cell Clc.

As illustrated in FIG. 4, a shift in the data voltage ΔV caused by a kick back voltage or a feed through voltage is generated in the driving signal. ΔV generates a residual image caused by an offset DC voltage as well as flicker caused by periodically changing brightness of the display picture. The ΔV is defined by the following equation:

$$\Delta V = \frac{Cgd}{Cgd + Clc + Cst}(Vgh - Vgl) \tag{1}$$

As can be seen from the equation, the ΔV is in proportion to a difference between a gate high voltage Vgh and a gate low voltage Vgl.

SUMMARY OF THE INVENTION

Accordingly, the present invention is directed to a shift register and a liquid crystal display using the same that substantially obviates one or more problems due to limitations and disadvantages of the related art.

An object of the present invention is to provide a shift register and a liquid crystal display using the same that reduces residual image and flicker to improve picture quality characteristics.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a shift register includes control means for receiving a high-level supply voltage and a first clock signal to generate a first control signal using the high-level supply voltage in response to any one of a start pulse and an output signal of a previous stage and to generate a second control signal using the high-level supply voltage in response to the first clock signal, and output means for receiving a second clock signal and applying the second clock signal to an output node in response to the first control signal to generate an output signal and for discharging the output node in response to the second control signal.

In another aspect, a liquid crystal display device includes a liquid crystal display panel having data lines and gate lines intersecting each other and a plurality of liquid crystal cells defined by each intersection of the data lines and the gate lines, a data driving circuit to apply a video data voltage to the data lines, and a gate driving circuit to sequentially apply a scanning pulse to the gate lines, the gate driving circuit including a shift register, the shift register including, control means for receiving a high-level supply voltage and a first clock signal to generate a first control signal using the high-level supply voltage in response to any one of a start pulse and an output signal of a previous stage and to generate a second control signal using the high-level supply voltage in response to the first clock signal, and output means for receiving a second clock signal and applying the second clock signal to an output node in response to the first control signal to generate an output signal and for discharging the output node in response to the second control signal.

In yet another aspect, a shift register for a gate driving circuit in a liquid crystal display device, the shift register including a plurality of stages, each stage includes a control block connected to receive a first clock signal, a start pulse, and a high-level supply voltage to generate a first control signal and a second control signal, and an output block connected to receive a second clock signal, the first control signal, and the second control signal to generate an output voltage in response to the first and second control signals.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
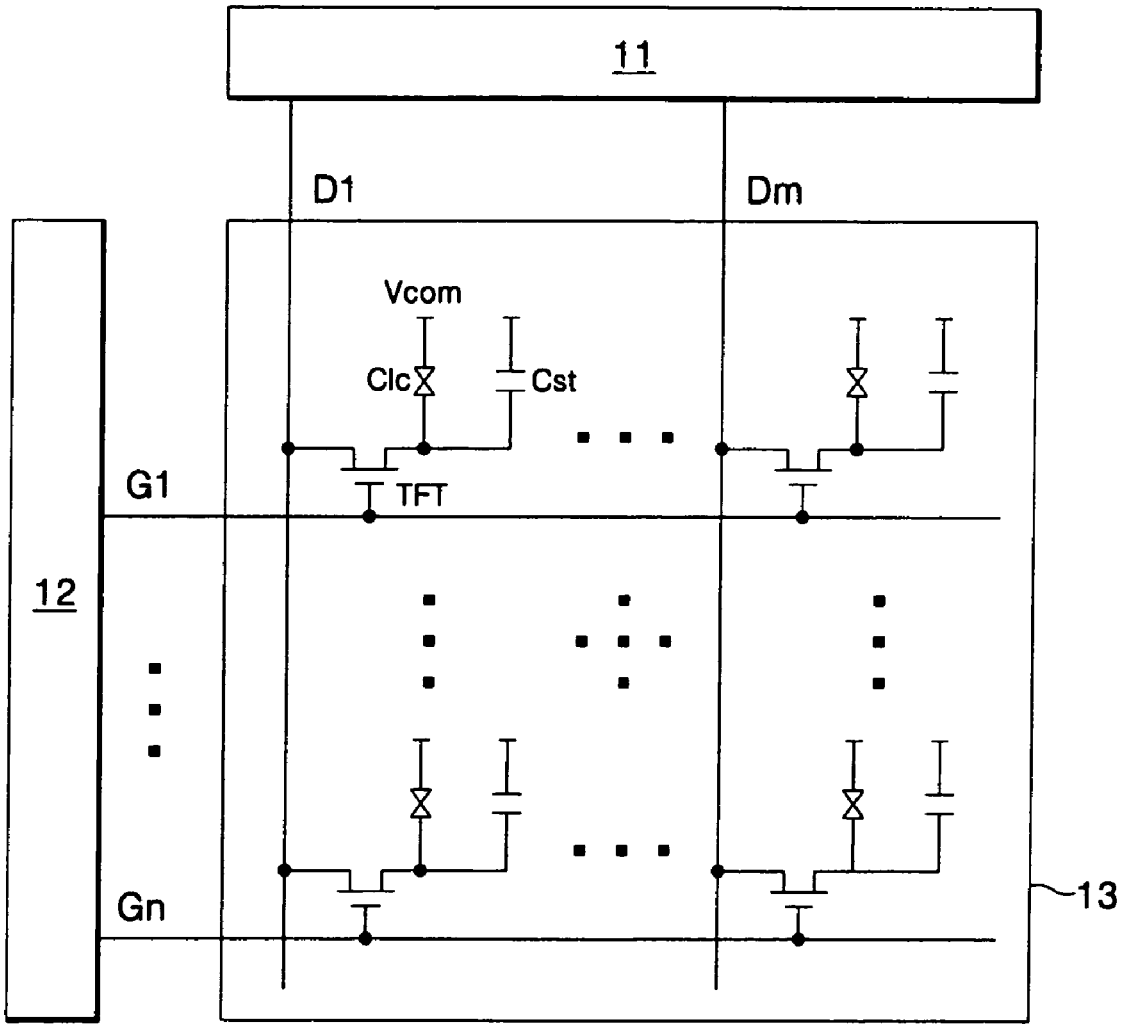
FIG. 1 RELATED ART
FIG. 1 is a plan view diagram showing a configuration of a related art liquid crystal display device.
Figure 2:
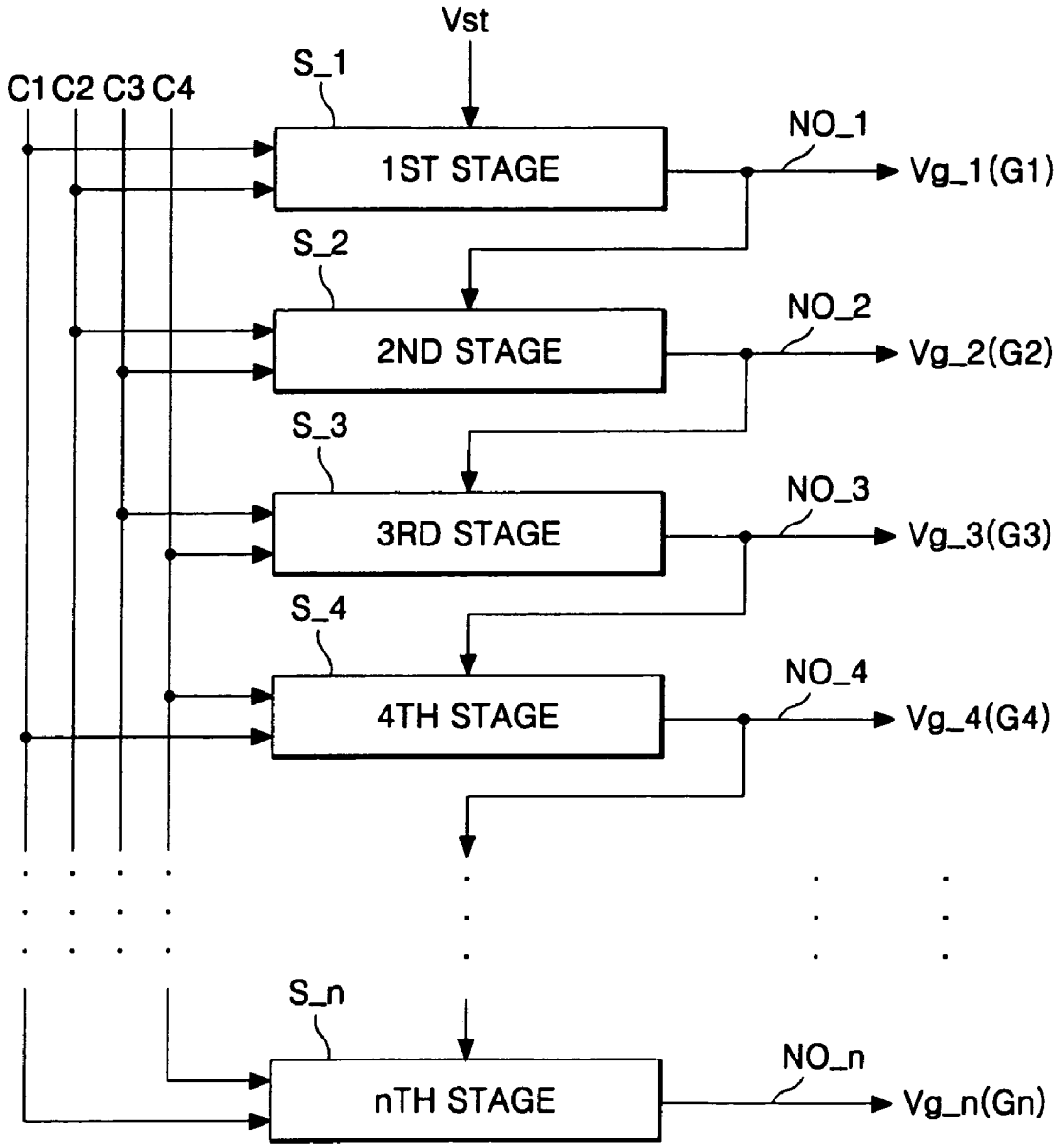
FIG.2 RELATED ART
FIG. 2 is a block diagram of the shift register shown in FIG. 1.
Figure 3:
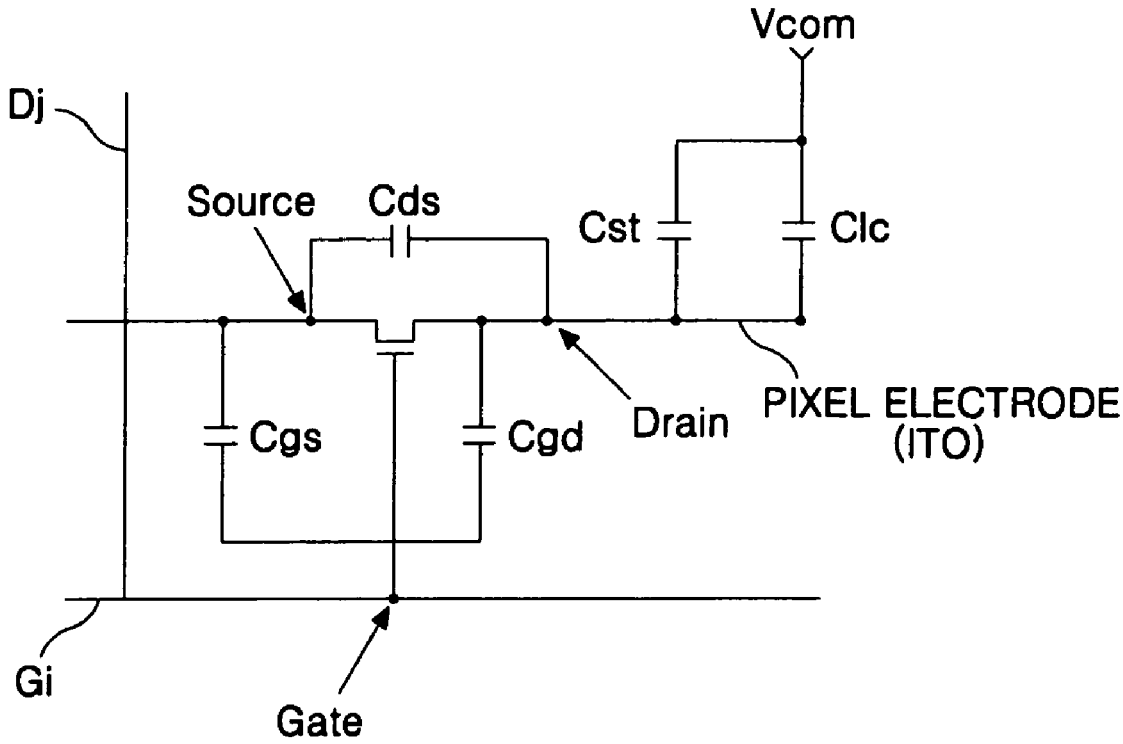
FIG. 3 RELATED ART
FIG. 3 is an equivalent circuit diagram of a unit pixel of the liquid crystal display device shown in FIG. 1.
Figure 4:
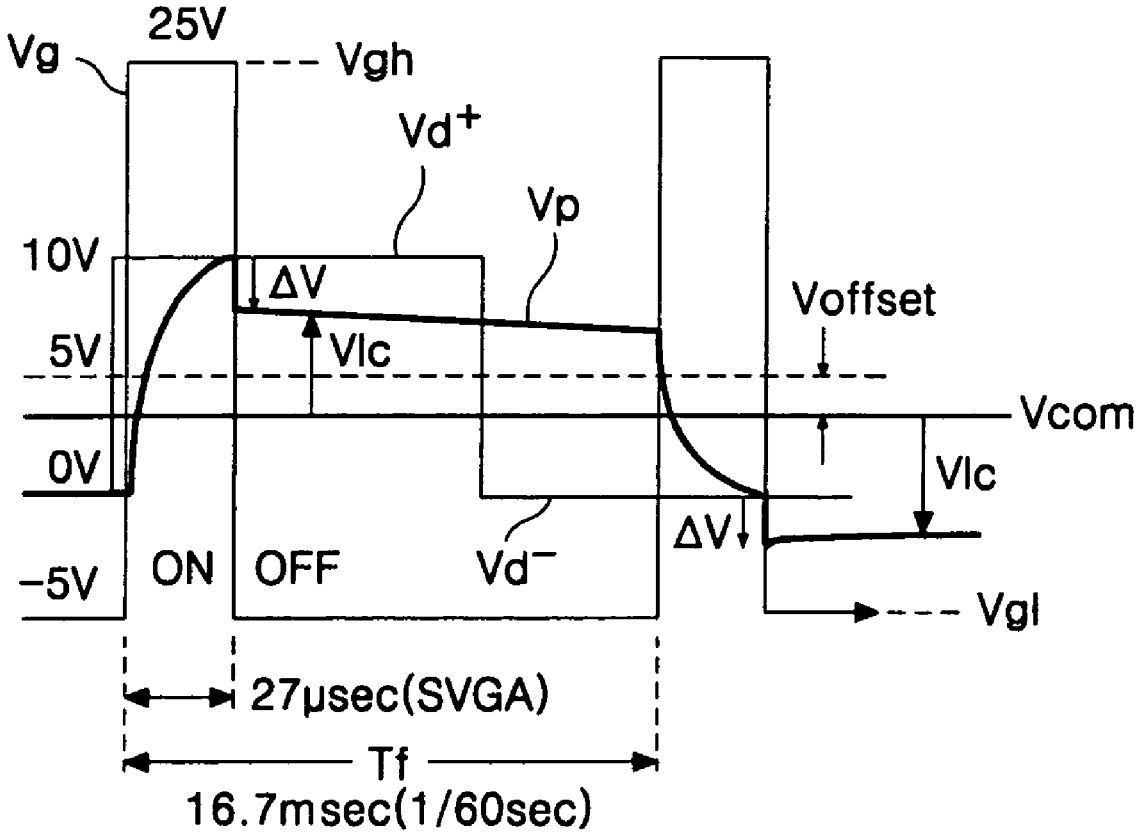
FIG. 4 RELATED ART
FIG. 4 is a waveform diagram of a driving signal of the liquid crystal display device shown in FIG. 1.
Figure 5:
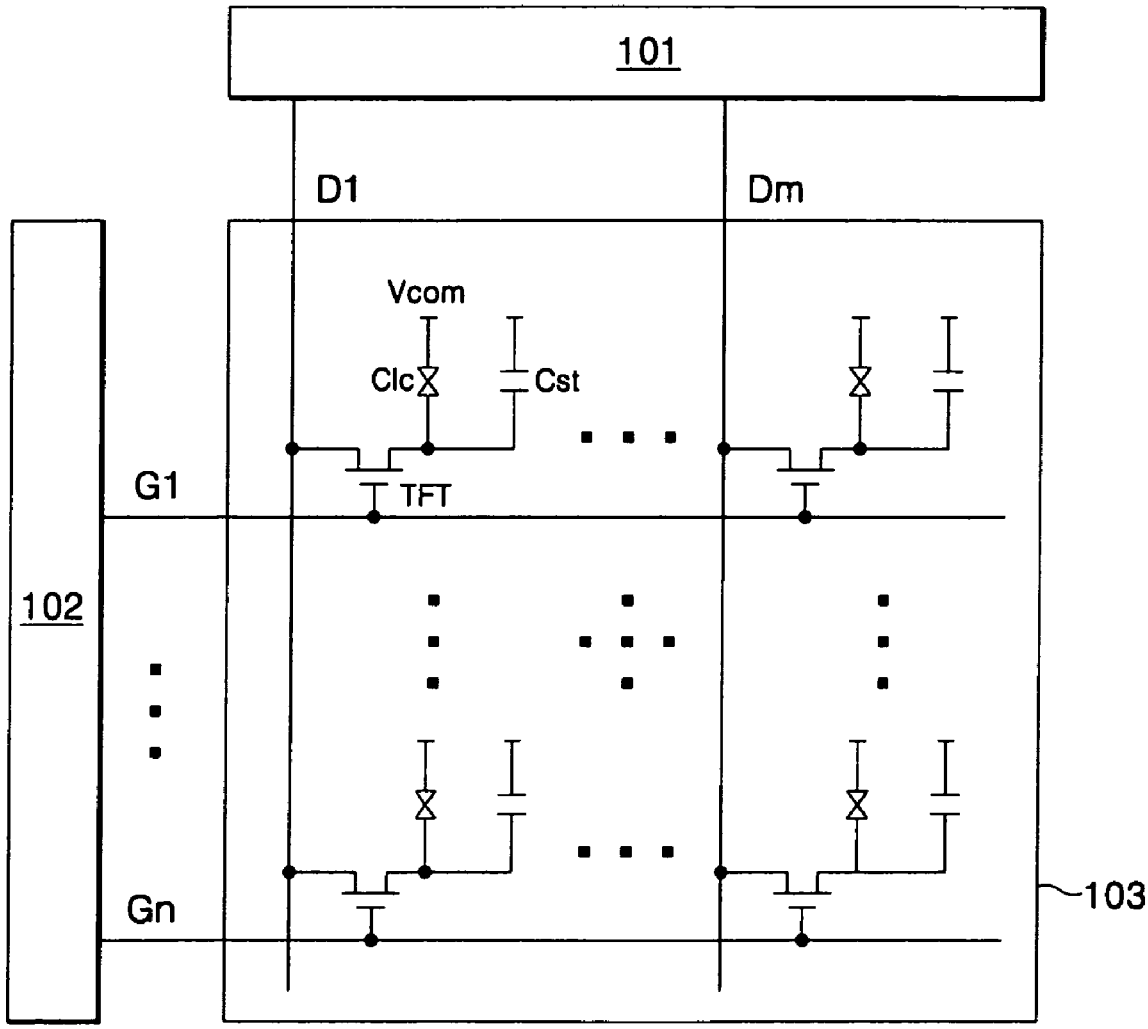
FIG. 5 is a plan view diagram showing an exemplary configuration of a liquid crystal display device according to an exemplary embodiment of the present invention.

FIG. 5 shows a liquid crystal display (LCD) device according to an exemplary embodiment of the present invention. As shown, the active matrix LCD device according to the exemplary embodiment of the present invention includes an LCD panel 103 having (m×n) liquid crystal cells Clc arranged in a matrix array, m data lines D1 to Dm and n gate lines G1 to Gn intersecting each other, and thin film transistors (TFT's) provided at intersections thereof. The active matrix LCD device according to the exemplary embodiment of the present invention further includes a data driving circuit 101 for applying video data signals to the data lines D1 to Dm of the LCD panel 103, and a gate driving circuit 102 for applying a scanning pulse to the gate lines G1 to Gn.

The LCD panel 103 has liquid crystal molecules injected between two glass substrates. The data lines D1 to Dm and the gate lines G1 to Gn provided at the lower glass substrate of the LCD panel 13 cross each other perpendicularly. The TFT provided at each intersection between the data lines D1 to Dm and the gate lines G1 to Gn applies a data voltage supplied via the data line D1 to Dn to the liquid crystal cell Clc in response to a scanning pulse from the gate line G1 to Gn. To this end, the gate electrode of the TFT is connected to one of the gate lines G1 to Gn while the drain electrode thereof is connected to one of the data lines D1 to Dm. Further, the source electrode of the TFT is connected to a pixel electrode of the liquid crystal cell Clc. The upper glass substrate of the LCD panel 103 is provided with black matrices, color filters, and common electrodes (not shown). A polarizer (not shown) having a perpendicular light axis is attached onto the upper and lower glass substrates of the LCD panel 103, and an alignment film (not shown) for establishing a free-tilt angle of the liquid crystal is provided at the inner side thereof tangent to the liquid crystal. Each liquid crystal cell Clc of the LCD panel 103 is provided with a storage capacitor Cst. The storage capacitor Cst is provided between the pixel electrode of the liquid crystal cell Clc and the pre-stage gate line or between the pixel electrode of the liquid crystal cell Clc and a common electrode line (not shown), thereby constantly maintaining a voltage of the liquid crystal cell Clc.

The data driving circuit 101 includes a plurality of data driving integrated circuits (ICs), each of the data driving ICs including a shift register, a latch, a digital-to-analog (D/A) converter and an output buffer. The data driving circuit 101 latches a digital video data and converts the digital video data into an analog gamma compensation voltage to thereby apply them to the data lines D1 to Dm. The data driving ICs are attached onto the substrate with the aid of a tape carrier package (TCP) or are directly mounted on the substrate by a chip on glass (COG) system.

Figure 6:
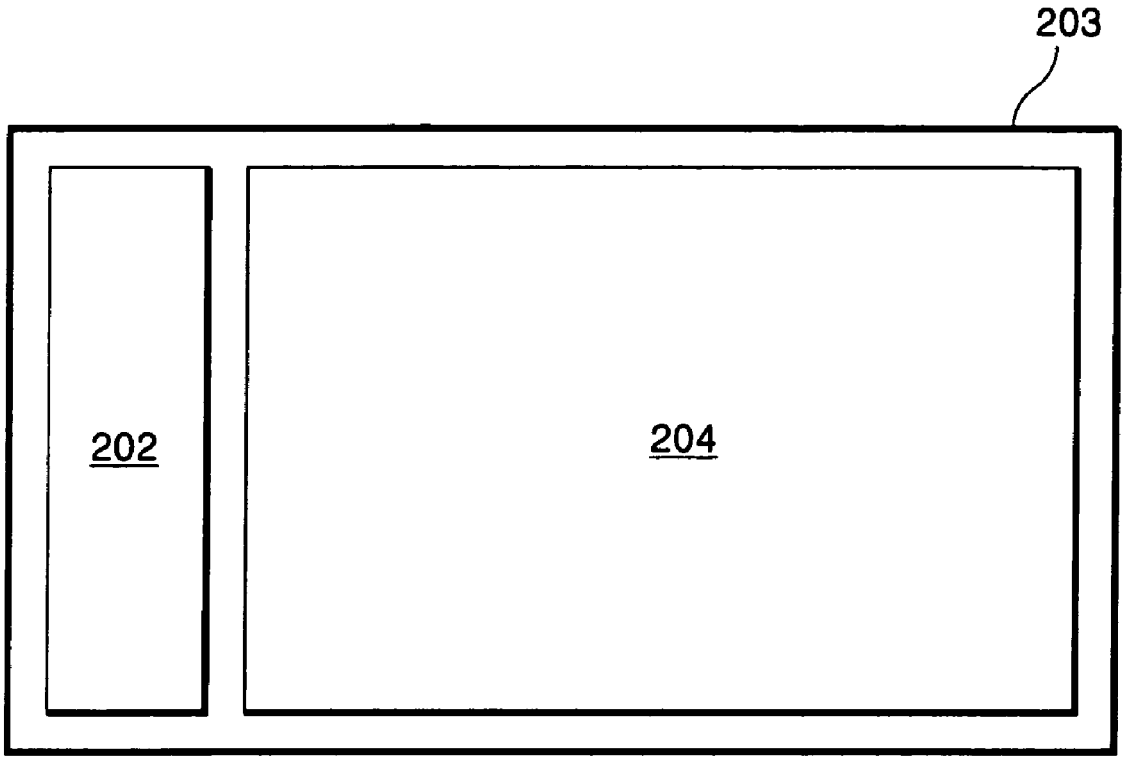
FIG. 6 is a schematic plan view showing an exemplary structure of a liquid crystal display panel in which a gate driving circuit is built.

The gate driving circuit 102 includes a plurality of gate driving ICs, each of which includes a shift register for sequentially shifting a start pulse every one horizontal period to generate a scanning pulse, a level shifter for converting an output signal of the shift register into a swing width suitable for driving the liquid crystal cell Clc, and an output buffer connected between the level shifter and a corresponding one of the gate lines G1 to Gn. The gate driving circuit 102 sequentially applies the scanning pulse to the gate lines G1 to Gn to select a horizontal line of the LCD panel 103 supplied with data. Such gate driving ICs 102 are integrated onto the substrate of the LCD panel 103 with the aid of the TCP as shown in FIG. 5. In the alternative, gate driving ICs 202 can be directly mounted on the substrate of the LCD panel 203 as a COG system as shown in FIG. 6.

Figure 7:
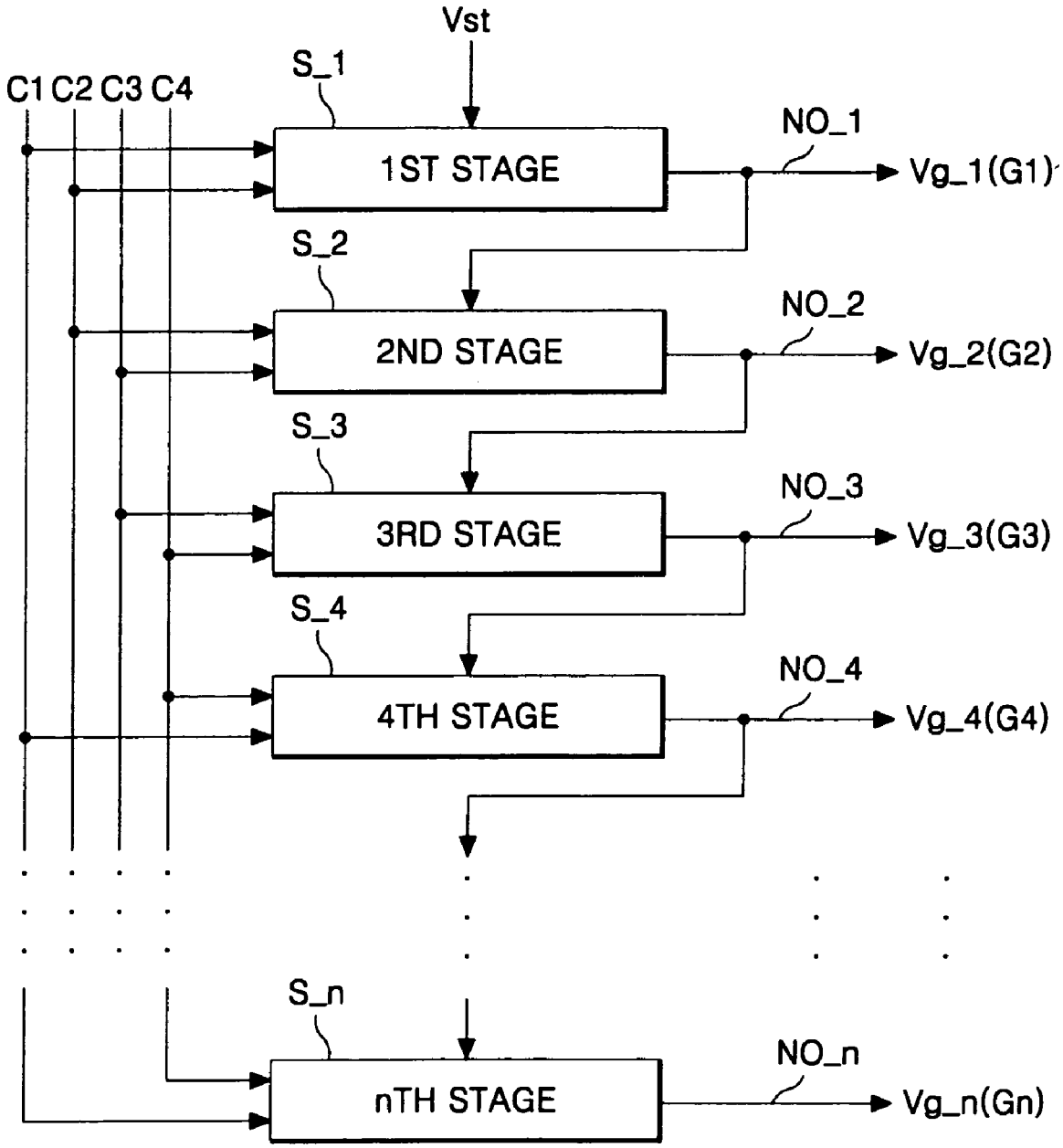
FIG. 7 is a block diagram of the shift register shown in FIG. 5 and FIG. 6.
Figure 8:
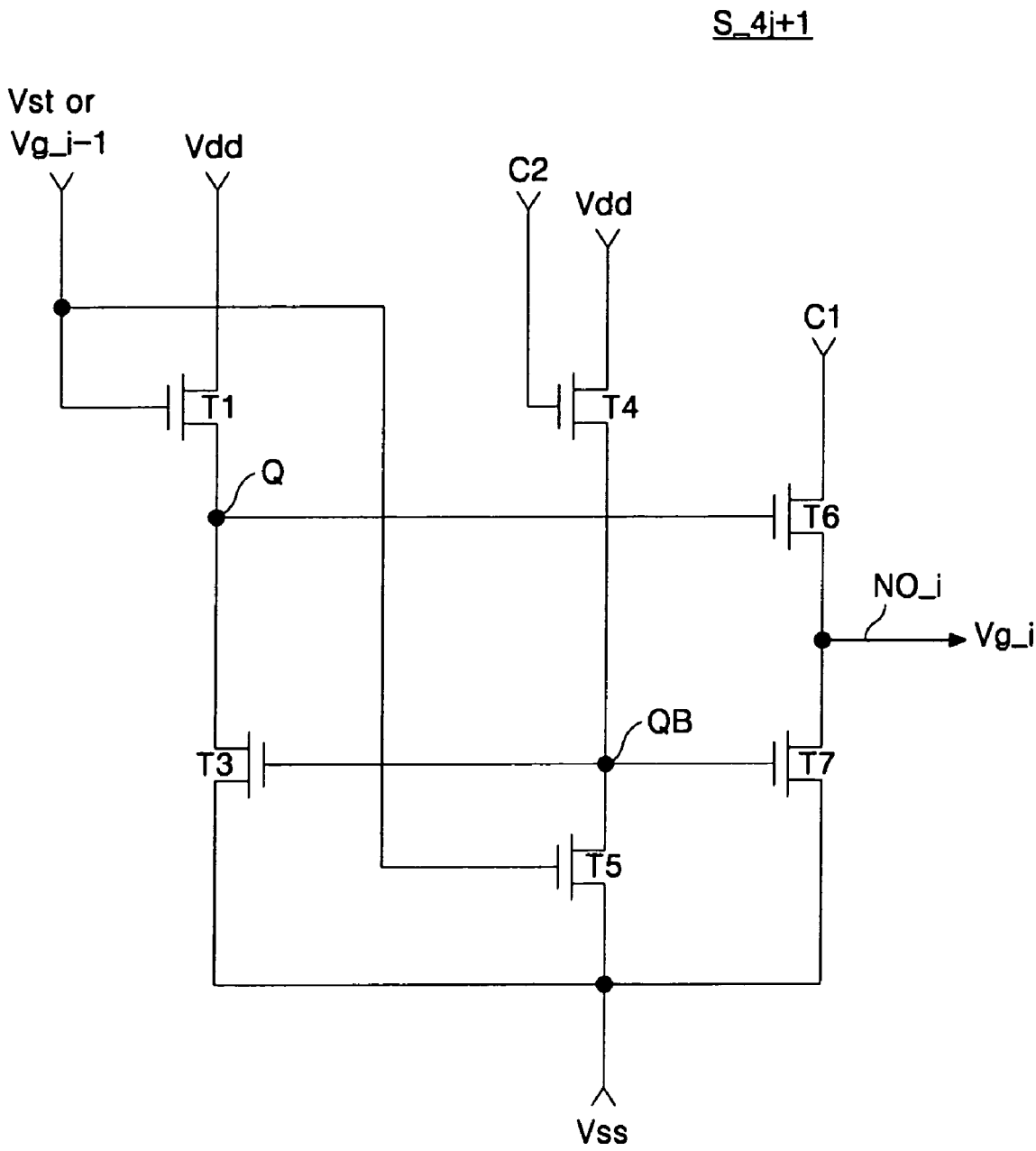
FIG. 8 is an exemplary circuit diagram of each stage of the shift register shown in FIG. 7.
Figure 9:
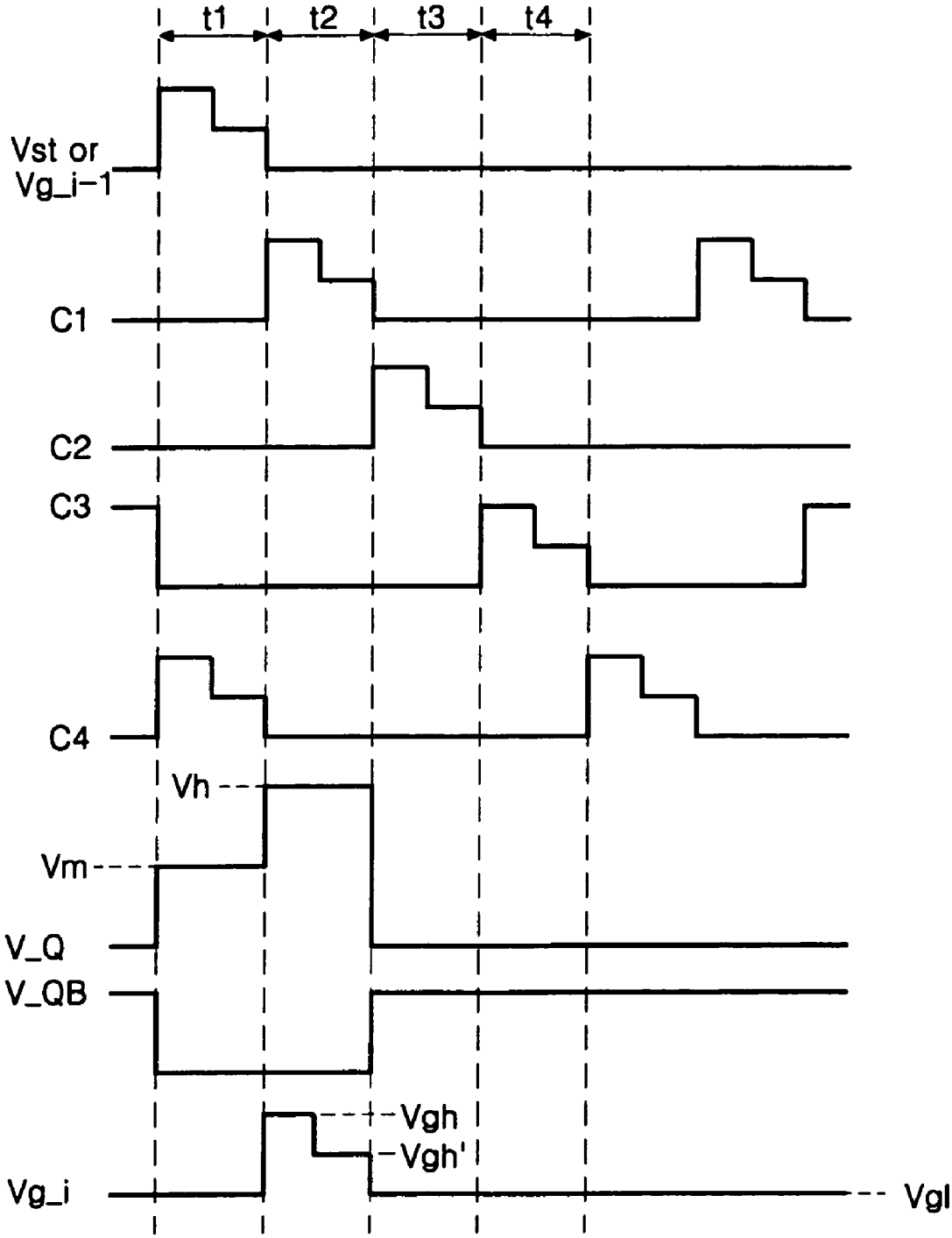
FIG. 9 is a waveform diagram of each node voltage at the circuit shown in FIG. 8.

FIG. 7 to FIG. 9 show an exemplary shift register circuit configuration of the gate driving circuit 102 or 202 and each node voltage waveform thereof. As illustrated in FIG. 7, the exemplary shift register according to an exemplary embodiment of the present invention includes n stages S_1 to S_n connected in cascading fashion. A level shifter and an output buffer (not shown) are provided between the stages S_1 to S_n and corresponding ones of the gate lines G1 to Gn.

A start pulse Vst is input to the first stage S_1 while each of stages S_2 to S_n receives output signal of its previous stage (i.e., one of Vg_1 to Vg_n−1) as a start pulse. Further, each of the stages S_1 to S_n has the same circuit configuration and shifts the start pulse Vst or the output signals Vg_1 to Vg_n−1 of the previous stages in response to two of four multi-step clock signals C1 to C4 (as shown in FIG. 9 and described later), thereby generating a multi-step scanning pulse having a pulse width of one horizontal period. The multi-step scanning pulse generated in accordance with the present invention lowers the gate high voltage Vgh in advance of a data voltage charge period in the liquid crystal cell Clc, thereby reducing the magnitude of ΔV as seen from the equation (1). Such a reduction of ΔV decreases a residual image caused by the offset DC voltage and decreases flicker to thereby enhance picture quality characteristics.

Although capacitance of the storage capacitor Cst can be enlarged to reduce the magnitude of ΔV, this strategy has a drawback in that an aperture ratio of the LCD panel will be reduced. In contrast, application of a clock signal having a multi-step waveform in accordance with the present invention reduces the magnitude of ΔV without reducing the aperture ratio of the LCD panel. In fact, the capacitance of the storage capacitor Cst can be further reduced to improve the aperture ratio in accordance with the present invention.

FIG. 8 shows a detailed exemplary circuit configuration of a (4*j*+1)th stage S_4*j*+1 (wherein j=0, 1, 2, . . . ) of a first stage S_i (wherein i is an integer smaller than or equal to n) in the shift register shown in FIG. 7. The stage S_4*j*+1 includes a sixth transistor T6 for applying a high logical voltage signal to an output node NO_i, and a seventh transistor T7 for applying a low logical voltage signal to the output node NO_i. An operation of the stage S_4*j*+1 will be described in detail in conjunction with FIG. 9 below.

As illustrated in FIG. 9, during a time interval t1 when the first and second clock signals C1 and C2 remain at a low logical voltage, the start pulse Vst or the output signal Vg_i−1 of the previous stage having a high logical voltage is applied to the gate electrodes of the first and fifth transistors T1 and T5 to thereby turn on the first and fifth transistors T1 and T5. At this time, a voltage V_Q at a first node Q is raised into a middle voltage Vm by a high-level supply voltage Vdd applied via the first transistor T1 to turn on the sixth transistor T6. During this time, voltage Vg_i at the output node NO_i remains at a low logical voltage because the first clock signal C1 remains at a low logical voltage. Turning on of the fifth transistor T5 lowers a voltage at a second node QB to turn off the seventh transistor T7, thereby shutting off a discharge path of the first node Q.

During time interval t2, the first clock signal C1 is inverted into a high logical voltage while the start pulse Vst or the output signal Vg_i−1 of the previous stage is inverted into a low logical voltage. At this time, the first and fifth transistors T1 and T5 are turned off, and the voltage V_Q at the first node Q is added to a voltage charged in a parasitic capacitor between the drain electrode and the gate electrode of the sixth transistor T6, which is supplied with a high logical voltage of the first clock signal C1, thereby raising the voltage more than a threshold voltage of the sixth transistor T6. In other words, the voltage V_Q at the first node Q rises to voltage Vh, which is higher than during the time interval t1, by bootstrapping. Thus, during the time interval t2, the sixth transistor T6 is turned on, and voltage Vg_i at the output node NO_i rises with the aid of voltage from the first clock signal C1 supplied by a conduction of the sixth transistor T6 to be inverted into a high logical voltage.

During time interval t3, the first clock signal C1 is inverted into a low logical voltage while the second clock signal C2 is inverted into a high logical voltage. At this time, the fourth transistor T4 is turned on in response to the second clock signal C2, and the high-level supply voltage Vdd is applied to the second node QB via the fourth transistor T4 to thereby raise voltage V_QB at the second node QB. The raised voltage V_QB at the second node QB turns on the seventh transistor T7 to discharge the voltage Vg_i at the output node NO_i into a ground voltage Vss and, at the same time, turns on the third transistor T3 to discharge the voltage V_Q at the first node Q into the ground voltage Vss.

During a time interval t4, if the second clock signal C2 is inverted into a low logical voltage, then the fourth transistor T4 is turned off. At this time, a high logical voltage is floated at the second node QB. A high logical voltage at the second node QB is maintained during the remaining frame interval.

The exemplary shift register according to the present invention, which has a structure for charging the first node Q from the high-level supply voltage Vdd, charges the first node Q faster and at a more stable state than the related art shift register, which has a structure for charging the first node Q from the start pulse Vst or the output signal Vg_i−1 from the previous stage. Accordingly, the shift register according to the exemplary embodiment of the present invention prevents a phenomenon experienced by the related art shift register, which includes a gradual reduction of the output voltage as it is sequentially shifted through the register.

Figure 10:
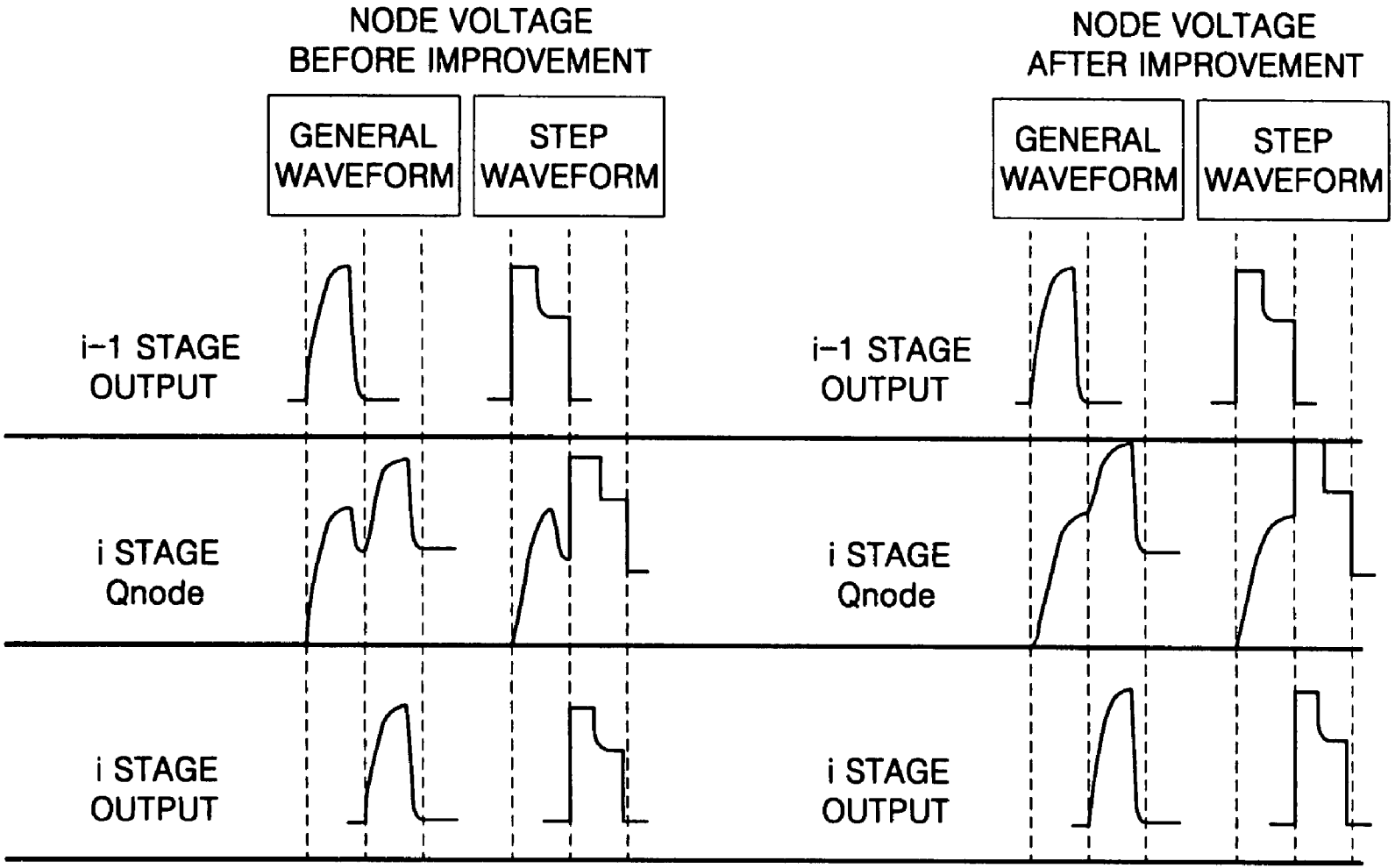
FIG. 10 is a waveform diagram of an output voltage at the circuit shown in FIG. 8.

FIG. 10 shows a comparison of the voltage waveforms resulting from the related art shift register with that of the present invention. As shown, the shift register according to the exemplary embodiment of the present invention improves the charged voltage at the first node and the output voltage at the output node. That is to say, the shift register according to the exemplary embodiment of the present invention can supply a multi-step scanning pulse at a more stable state.

Figure 11:
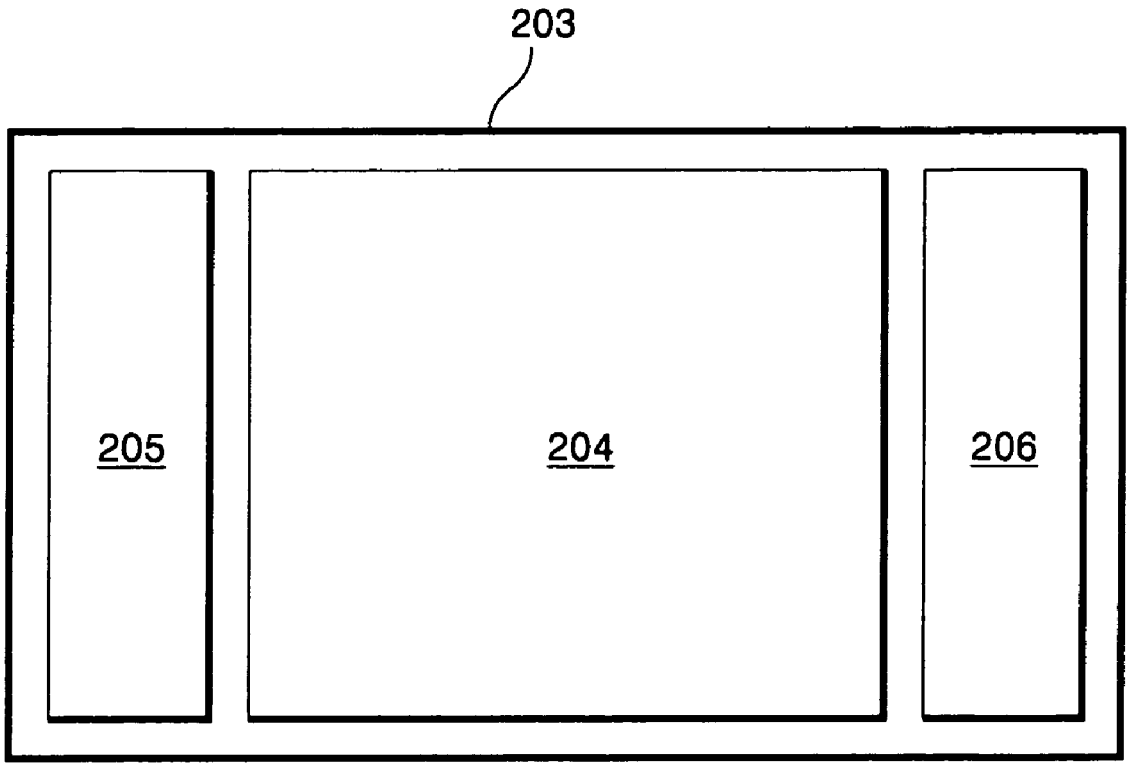
FIG. 11 is a schematic plan view showing another exemplary structure of a liquid crystal display panel in which a gate driving circuit is built.

As shown in FIG. 11, the gate driving ICs may be provided separately at each side of the LCD panel 203. In this exemplary structure, each stage of the shift register has a slightly different configuration than that of the structure in which the gate driving ICs are provided only on one side of the LCD panel 203. The exemplary structure of the shift registers in accordance with the exemplary embodiment of FIG. 11 is disclosed in Korean patent application No. P2005-0046395 and incorporated herein by reference.

As described above, the multi-step scanning pulse generated by the multi-step clock signal in accordance with the present invention can reduce residual images and flicker to thereby improve picture quality of the LCD device of the present invention. Furthermore, the shift register in accordance with the exemplary embodiment of the present invention in which the Q node is charged stably and rapidly by the high-level supply voltage prevents the phenomenon of a gradually decreasing output voltage due to sequentially shifted output voltage in the related art.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents. It will be apparent to those skilled in the art that various modifications and variations can be made in the shift register of the present invention and liquid crystal display using the same without departing form the spirit or scope of the invention. Thus, it is intended that the present invention cover the modifications and variations of this invention provided they come within the scope of the appended claims and their equivalents.

What is claimed is:

1. A shift register for a liquid crystal display, comprising:

control means for receiving a high-level supply voltage and a first multi-step clock signal to generate a first control signal using the high-level supply voltage in response to any one of a start pulse and an output signal of a previous stage and to generate a second control signal using the high-level supply voltage in response to the first multi-step clock signal; and output means for receiving a second multi-step clock signal and applying the second multi-step clock signal to an output node in response to the first control signal to generate a multi-step output signal and for discharging the output node in response to the second control signal, wherein each of the first multi-step clock signal, the second multi-step clock signal and the output multi-step signal has a high level and a low level, and the high level has a first voltage level in the first period of the high level and a second voltage level lower than the first voltage level in the latter period of the high level.

2. The shift register according to claim 1, wherein the output means includes:

a first transistor to apply the second multi-step clock signal to the output node in response to a voltage at a first node; and a second transistor to discharge the output node in response to a voltage at a second node.

3. The shift register according to claim 2, wherein the control means includes:

a third transistor to apply the high-level supply voltage to the first node in response to the any one of the start pulse and the output signal of the previous stage;

a fourth transistor to apply the high-level supply voltage to the second node in response to the first multi-step clock signal;

a fifth transistor to discharge the second node in response to the any one of the start pulse and the output signal of the previous stage; and a sixth transistor to discharge the first node in response to the voltage at the second node.

4. A liquid crystal display device, comprising:

a liquid crystal display panel having data lines and gate lines intersecting each other and a plurality of liquid crystal cells defined by each intersection of the data lines and the gate lines;

a data driving circuit to apply a video data voltage to the data lines; and a gate driving circuit to sequentially apply a scanning pulse to the gate lines, the gate driving circuit including a shift register, the shift register including, control means for receiving a high-level supply voltage and a first multi-step clock signal to generate a first control signal using the high-level supply voltage in response to any one of a start pulse and an output signal of a previous stage and to generate a second control signal using the high-level supply voltage in response to the first multi-step clock signal, and output means for receiving a second multi-step clock signal and applying the second multi-step clock signal to an output node in response to the first control signal to generate a multi-step output signal and for discharging the output node in response to the second control signal, wherein each of the first multi-step clock signal, the second multi-step clock signal and the output multi-step signal has a high level and a low level, and the high level has a first voltage level in the first period of the high level and a second voltage level lower than the first voltage level in the latter period of the high level.

5. The liquid crystal display device according to claim 4, wherein the output means includes:

a first transistor to apply the second multi-step clock signal to the output node in response to a voltage at a first node; and a second transistor to discharge the output node in response to a voltage at a second node.

6. The liquid crystal display device according to claim 5, wherein the control means includes:

a third transistor to apply the high-level supply voltage to the first node in response to the any one of the start pulse and the output signal of the previous stage;

a fourth transistor to apply the high-level supply voltage to the second node in response to the first multi-step clock signal;

a fifth transistor to discharge the second node in response to the any one of the start pulse and the output signal of the previous stage; and a sixth transistor to discharge the first node in response to the voltage at the second node.

7. The liquid crystal display device according to claim 4, wherein the gate driving circuit is provided on a substrate of the liquid crystal display panel.

8. A shift register for a gate driving circuit in a liquid crystal display device, the shift register including a plurality of stages, each stage comprising:

a control block connected to receive a first multi-step clock signal, a start pulse, and a high-level supply voltage to generate a first control signal and a second control signal; and an output block connected to receive a second multi-step clock signal, the first control and the second control signal to generate an output voltage in response to the first and second control signals, wherein each of the first multi-step clock signal, the second multi-step clock signal and the output multi-step signal has a high level and a low level, and the high level has a first voltage level in the first period of the high level and a second voltage level lower than the first voltage level in the latter period of the high level.

9. The shift register according to claim 8, wherein the start pulse is a voltage from a start pulse voltage source.

10. The shift register according to claim 8, wherein the start pulse is an output voltage from a previous stage.

11. The shift register according to claim 8, wherein the output block includes:

a first transistor to apply the second multi-step clock signal to an output node as the output voltage in response to the first control signal; and a second transistor to discharge the output node in response to the second control signal.

12. The shift register according to claim 11, wherein the control block includes:

a third transistor to apply the high-level supply voltage to a first node in response to the start pulse to generate the first control signal;

a fourth transistor to apply the high-level supply voltage to a second node in response to the first multi-step clock signal to generate the second control signal;

a fifth transistor to discharge the second node in response to the start pulse; and a sixth transistor to discharge the first node in response to the second control signal.

* * * * *